US006008768A

United States Patent [19]

Wilson et al.

[11] Patent Number: 6,008,768

[45] Date of Patent: Dec. 28, 1999

[54] NO GROUND ANTENNA

[75] Inventors: James W. Wilson; Dwight S. Heim, both of Las Vegas, Nev.; Patrick L. Cook, St. George, Utah

[73] Assignee: Wilson Antenna, Inc., Las Vegas, Nev.

[21] Appl. No.: 09/166,980

[22] Filed: Oct. 6, 1998

[51] Int. Cl.[6] ..... H01Q 9/00; H01Q 9/30; H01Q 1/32

[52] U.S. Cl. ..... 343/749; 343/900; 343/713; 343/715

[58] Field of Search ..... 343/745, 749, 343/790, 791, 792, 860, 861, 862, 863, 864, 713, 715, 895, 793, 802, 900

[56] References Cited

U.S. PATENT DOCUMENTS

| | | | |
|---|---|---|---|
| 3,761,938 | 9/1973 | Reggia | 343/785 |
| 3,961,332 | 6/1976 | Middlemark | 343/802 |
| 4,209,790 | 6/1980 | Newcomb | 343/830 |
| 4,218,687 | 8/1980 | Faigen et al. | 343/885 |
| 4,407,000 | 9/1983 | Sasaki et al. | 343/726 |
| 4,730,195 | 3/1988 | Phillips et al. | 343/792 |
| 4,827,275 | 5/1989 | Fusinski | 343/726 |
| 4,968,991 | 11/1990 | Yamazaki | 343/715 |
| 5,541,521 | 7/1996 | North et al. | 324/628 |
| 5,568,161 | 10/1996 | Fulmer, Sr. | 343/816 |
| 5,764,193 | 6/1998 | Uchino et al. | 343/725 |

*Primary Examiner*—Don Wong
*Assistant Examiner*—Jennifer H Malos
*Attorney, Agent, or Firm*—Freilich, Hornbaker & Rosen

[57] ABSTRACT

An antenna includes a dipole (20) with upper and lower elongated conductors (22, 24) and a feedline (40) for carrying radio frequency currents to the dipole by connecting the feedline to the lower end (30) of the upper conductor and to the upper end (32) of the lower conductor, which produces maximum gain. A spacer (50) spaces the center of the feedline by a distance (A) of about 3 centimeters from the center of the lower conductor, to produce minimum losses while providing a compact antenna. A toroidal ferrite core (110) lies at the bottom of the lower conductor and the feedline is in the form of a wire pair that is wrapped a plurality of times about the ferrite core to prevent signals radiated by the lower conductor and picked up by the feedline, from passing to the radio. A tuning member (150) of electrically conductive material can be slid along the spacer to tune the antenna without changing its height (B).

8 Claims, 3 Drawing Sheets

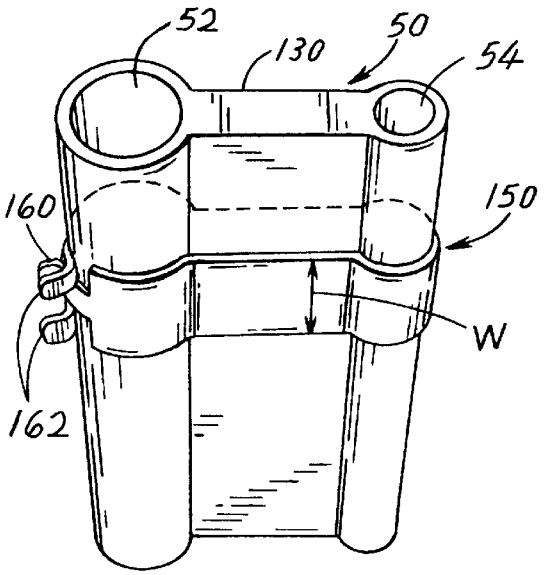
FIG. 4
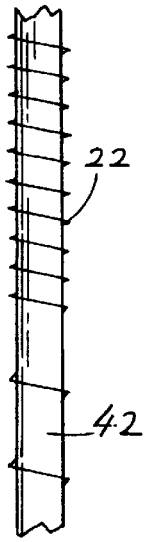
FIG. 5
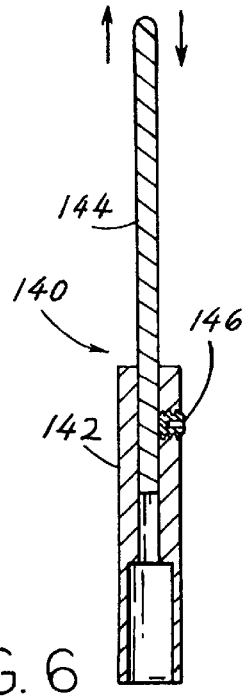
FIG. 6
FIG. 7
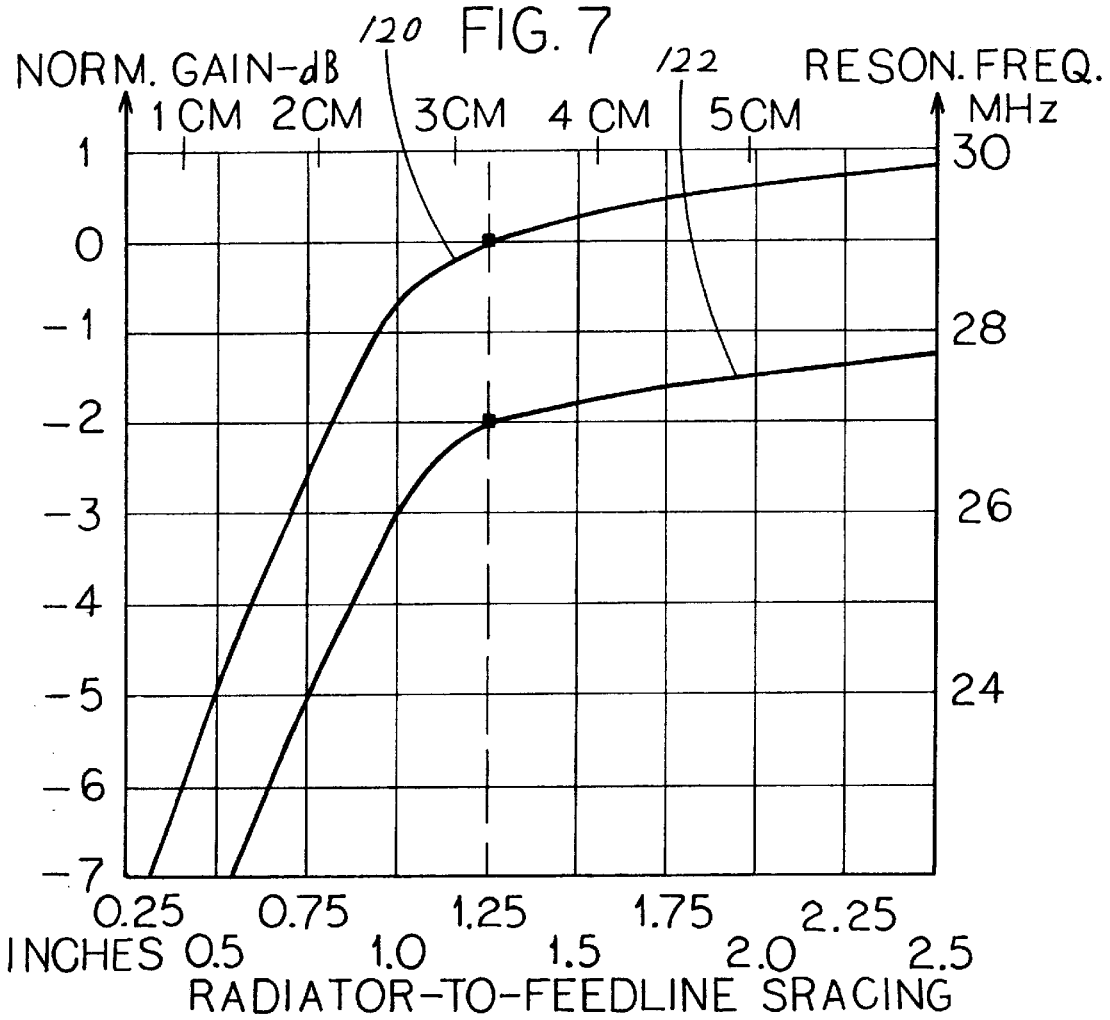

NO GROUND ANTENNA

BACKGROUND OF THE INVENTION

A common and efficient communication antenna used at a fixed location, includes a monopole radiating element, usually having a length of one-quarter wavelength, with a lower end lying at or slightly above the earth and with the antenna extending upwardly therefrom. The earthen ground plane provides the opposing element for the radiating system. Most AM broadcast stations use this approach. The monopole element may be elevated from the earth and ground and provided with an artificial, approximately horizontal ground plane formed by a conductive surface. Vehicle monopole radiators use this principle, by being mounted on or adjacent to a vehicle's metal roof or trunk surface, the metal surface providing an effective ground plane for the radiator.

Recently, vehicle bodies have been formed of composite plastic materials instead of metal, so there is no ground plane. A common solution is to connect an outer sheath of a coaxial feedline, to a metallic part of the frame such as the support structure, to provide at least some sort of opposing element. This is a marginal solution at best, due to the variables of poor conductivity, insufficient area, and movement of the connecting conductor. Marine applications have similar problems.

SUMMARY OF THE INVENTION

In accordance with one embodiment of the present invention, a communication antenna is provided that does not require a ground plane, the antenna being a vertical dipole. A dipole radiator typically consists of two quarter-wavelength elements arranged end-to-end and fed in the center. Most dipoles extend along a horizontal axis, which results in a bi-polar pattern. For vehicular application, an omnidirectional pattern is preferred, and a vertical dipole satisfies this requirement.

Radio frequency signals are passed to and from the antenna through a feedline that connects to the lower end of the upper radiator and the upper end of the lower radiator. In order to provide an antenna of moderate horizontal dimension, the feedline must be close to the lower radiator. Such proximity results in detuning that imbalances the dipole, and the coupling of energy from the lower radiator to the feedline which reduces gain. Applicant has found that losses in detuning follow curves that are steep at radiator-to-feedline distances much below 3 cm, but that are much flatter at distances of more than about 3 cm for frequencies on the order of 30 MHZ. A spacer is used to horizontally space the lower radiator from the feedline by a distance of about 3 cm.

Applicant uses an intermediate feedline, which extends from a coaxial connector to the radiator conductors, where the intermediate feedline is a twisted insulated wire pair with an impedance of about 50 ohms. A portion of the currents radiated by the lower radiator and picked up by the twisted pair are in phase and are self cancelling. Where the lower end of the twisted pair connects to the RF coaxial coupling, a conventional unbalanced coaxial feed cable extends to the radio where currents are generated and received. The intermediate feedline could allow some residual circulating currents at the junction of the twisted pair and a coaxial cable. These unwanted power-robbing currents are eliminated by wrapping a plurality of turns of the twisted pair about a ferrite toroidal core lying near the junction of the twisted pair and the RF coaxial coupling.

A tuning member of electrically conductive material has opposite ends lying adjacent to the feedline and to the lower conductor, respectively. The height of the tuning member can be adjusted to tune the antenna to different frequencies.

The novel features of the invention are set forth with particularity in the appended claims. The invention will be best understood from the following description when read in conjunction with the accompanying drawings.

BRIEF DESCRIPTION OF THE DRAWINGS

FIG. 4 is a perspective view of a portion of the spacer of FIG. 3.

FIG. 5 is a side elevation view of a portion of the dipole of the antenna of FIG. 3.

FIG. 6 is a sectional view of a portion of the antenna of FIG. 2.

FIG. 7 is a chart showing variation in normal gain with radiator-to-feedline spacing, and showing variation in resonant frequency with radiator-to-feedline spacing.

DESCRIPTION OF THE PREFERRED EMBODIMENTS

Figure 1:
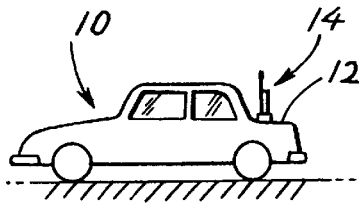
FIG. 1 is a side elevation view of a vehicle with an antenna of the present invention mounted thereon.
Figure 2:
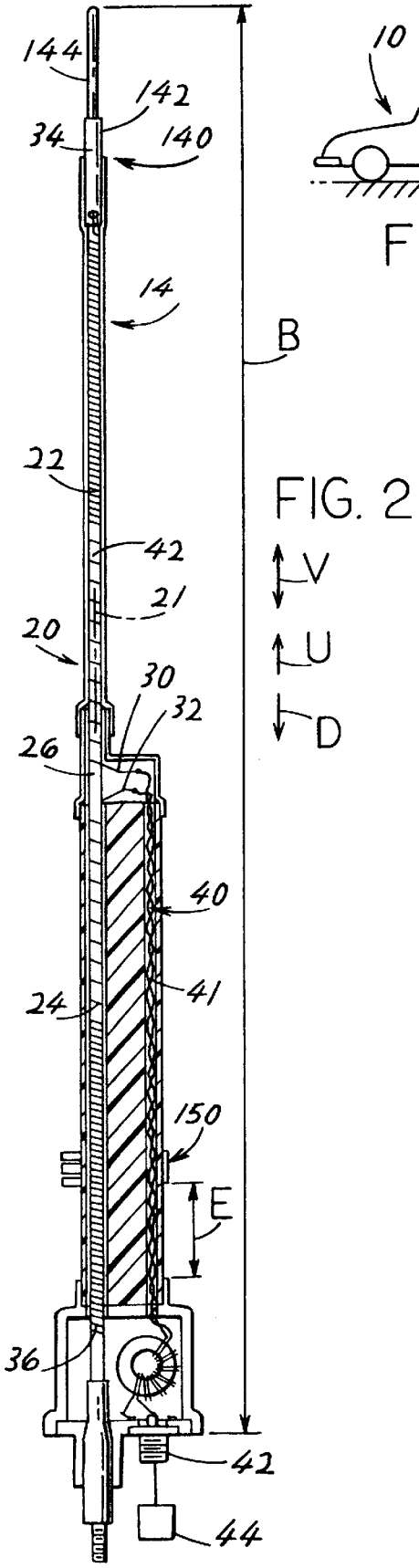
FIG. 2 is a sectional side view of the antenna of FIG. 1.

FIG. 1 illustrates an automobile 10 of a type that has a composite plastic body 12, and shows an antenna 14 mounted on the body. FIG. 2 shows that the antenna includes a dipole 20 that extends primarily vertically V, or in up and down directions U, D along an axis 21. The dipole includes upper and lower radiators 22, 24 and a middle 26 between them. Each radiator is in a form of a conductor with conductor inner ends 30, 32 lying at the middle of the dipole and with conductor outer ends 34, 36 lying furthest from each other. An intermediate feedline 40, which is part of a complete feedline 38, extends from a radio frequency coaxial coupling 42 to the inner ends 30, 32 of the radiators to supply radio frequency currents to and from the radiators with respect to a two-way radio 44.

The particular antenna illustrated was designed for use with radios with frequencies close to the citizen's band, or about 30 MHZ (between 15 MHZ and 45 MHz). At a common citizen band frequency of about 27 MHZ, the wavelength is about 36 feet, so it is necessary to physically shorten even a ¼ wave monopole and to greatly shorten the dipole. Shortening the radiating element transforms it from an almost purely resistive device to a highly capacitive device. The capacitance may be cancelled by inserting series inductance into the radiating element in either lumped or distributed form. A common practice is to construct a radiating element with distributed inductance by winding a continuous helix of wire on an insulative rod 42. Often the pitch of the helix is varied to optimize current distribution within the radiator. The dipole of FIG. 2 uses this approach to provide a one-half wavelength radiator fed at the center.

The antenna 14 includes a frame 48 that supports the dielectric rod 42 and the intermediate feedline 40 (the rod may be considered part of the frame). In accordance with the present invention, the frame includes a spacer 50 with a pair of vertical bores 52, 54. The lower radiator 24 which is a wire wound around an insulative or dielectric rod 42, extends through the first bore, while the intermediate feedline 40 has a radiator-opposite feedline portion 41 that extends through the second bore. The portion 41 extends largely parallel to and lies opposite the first radiator 24. The spacer is designed to maintain a predetermined spacing A between the vertical axes of the lower radiator conductor at 24 and the feedline at 40. Applicant prefers to use a twisted pair intermediate feedline at 40. The feedline has upper ends soldered at joints 60, 62 to the inner ends 30, 32 of the radiators. The intermediate feedline has lower ends 64, 66 joined to the inner and outer conductors of the coaxial cable coupling 42. A coaxial cable 70 which forms the rest of the complete feedline 38, connects to the two-way radio 44.

The radio is shown as including a transceiver 72 which diverts signals received by the antenna to a demodulator that delivers the demodulated signals to a loudspeaker 76. Audio signals from a microphone 86 are modulated, with the output delivered to the transceiver 72 which delivers it to the coaxial cable 70 of the feedline. The frame includes a metallic mounting stud or mount 90 which is designed to mount on a body 12, as by use of washers 92 and a nut 94, in the same manner as monopole antennas mount on steel bodies of vehicles. The mount 90 directly supports the dielectric rod 42 which is commonly of fiberglass so it is flexible. A lower housing part 100 encloses the bottom of the rod and the bottom of the intermediate feedline 40. A weather cap 102 surrounds the top of the intermediate feedline at the joints 60, 62. A heat shrink tube 104 is shrunk around the upper radiator.

Applicant positions a ferrite core 110, which is preferably in the shape of a toroid, within the lower housing part 100, at and preferably below the lower or outer end 36 of the lower radiator. The intermediate feedline 40 allows some residual currents at the junction of the twisted pair and the coaxial cable feedline 70, at the intermediate feedline lower ends 64, 66, to circulate. Applicant has found that such unwanted power-robbing currents can be almost totally eliminated by winding the intermediate feedline around the ferrite core 110, near the junction of the feedline with the coaxial coupling 42. This creates a radio frequency "choke" for currents external to the coaxial feedline. The intermediate twisted pair feedline and choke combination provides an excellent performance by reducing to almost zero the currents on the surface of the feedline that are induced by currents from the lower radiator. Such currents are of random phase and waste power. Although applicant prefers to twist the pair of insulated wires 112, 114, as this contributes to cancellation of the random induced currents in conjunction with the ferrite core, an untwisted pair can also be used although its performance is not quite as good.

It is desirable that the spacing A between the wire pair of the intermediate feedline 40 and the lower helical radiator 24, be maintained constant for consistent performance, and that an appropriate spacing A be chosen. FIG. 7 includes a graph 120 which shows variation in normalized gain, in decibels, versus the spacing A between the lower radiator and the intermediate feedline. The tests were conducted for a citizen's band frequency of about 27 MHZ. It can be seen that the greater the spacing, the greater the normalized gain, while the smaller the spacing the greater the loss. Although maximum gain is obtained for maximum spacing, the antenna should have an appearance similar to common monopole antennas which do not have a great width. Applicant notices that the slope of the curve 120 is largest up to about 1 inch, or 2.5 cm, and the slope of the curve is a minimum above about 1.25 inch (3 cm). As a result, applicant prefers to use a spacing A of about 3 cm (between about 2 cm and 4.5 cm). The spacing A should be a plurality of centimeters, or at least 2 centimeters, so that the gain is not greatly reduced. Although the spacing can be increased almost without limit, applicant prefers a spacing that is not too great, so the antenna does not appear to be of unusual or "awkward" shape. If appearance is not important, then the distance A can be increased to any length.

FIG. 7 also includes a graph 122 which shows the variation in resonant frequency with the radiator-to-feedline spacing A It also can be seen that there is a "break" in the curve 122 from a large slope below about 1 inch to a small slope above about 1.25 inch, and for this reason also, applicant prefers a spacing of about 1.25 inch (3 cm).

FIG. 4 shows the shape of the spacer 50. The spacer is an extruded plastic part, with the first and second bores 52, 54 being designed to closely receive the lower radiator and wire pair to maintain a substantially constant spacing between them. A web or rib 130 separates the walls that form the two bores.

Figure 3:
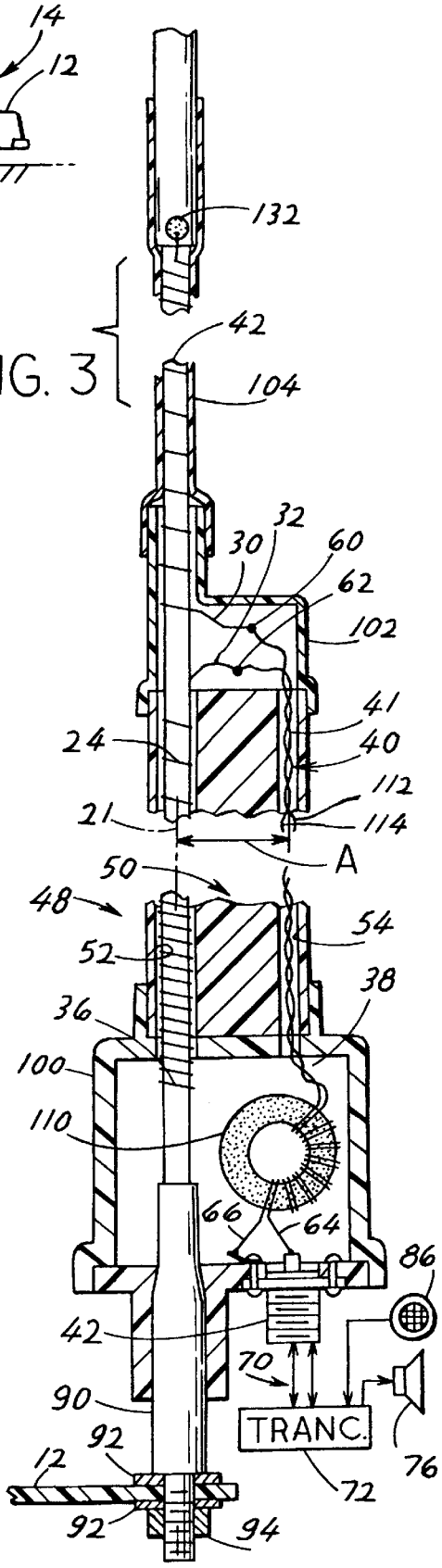
FIG. 3 is an enlarged view of portions of the antenna of FIG. 2.

FIG. 3 shows that the electrical conductor of the upper radiator 22 is soldered at 132 to a metal extension assembly 140 that includes a sleeve 142 and a tuning pin 144. As shown in FIG. 6, the tuning pin can be moved up and down and fixed in position with a set screw 146 to tune the dipole.

Tests have confirmed that the above design has performance characteristics about the same as those of a monopole/ground plane design, and exceeds the performance of a monopole mounted on a marginal ground plane. It should be noted that the dipole of this invention works equally well in the presence of a ground plane such as on a full metal vehicle, as on a structure without a ground plane such as on a composite plastic body of a vehicle. The present dipole antenna is also well suited for marine applications where a sufficient ground plane for conventional monopoles is often hard to achieve. For temporary or fixed applications, it provides a quick and easy way to put a radio on the air with good results. An apartment dweller might hang the present antenna out of the window by the coaxial cable, and a camper might hang it from a tree limb or lash it to the top of his tent, so a ground plane is not used. The present antenna was designed for use at the 11 meter citizen band and adjacent 10 meter amateur band of frequencies, but may be effectively applied to other operating frequencies. The spacing A for 30 MHZ is about 0.25 percent of a wavelength of the frequency. Accordingly, a general rule might be that the spacing A should be on the order of magnitude of 0.3 percent of the wavelength, or preferably at least 0.25 percent of the wavelength.

In an antenna that applicant has built and successfully tested, the overall height B (FIG. 2) was 49 inches. Each of the helically-wound wires that form the upper and lower radiators, had an outside coil diameter of 7/16 inch or 1.4 cm. The bores 52, 54 had diameters of 0.5 inch and 0.25 inch, respectively, with the distance A being 1.25 inch and with the rib 130 (FIG. 4) having a thickness of about 0.1 inch. The wire pair forming the intermediate feedline 40 was twisted about 1 turn per inch, and was wrapped 8 times about the toroidal core 110, which had an outside diameter of 7/8 inch and an inside diameter of about 0.6 inch.

FIG. 4 shows a tuning member 150 that can be moved vertically to a selected position along the dielectric spacer

Figure 8:
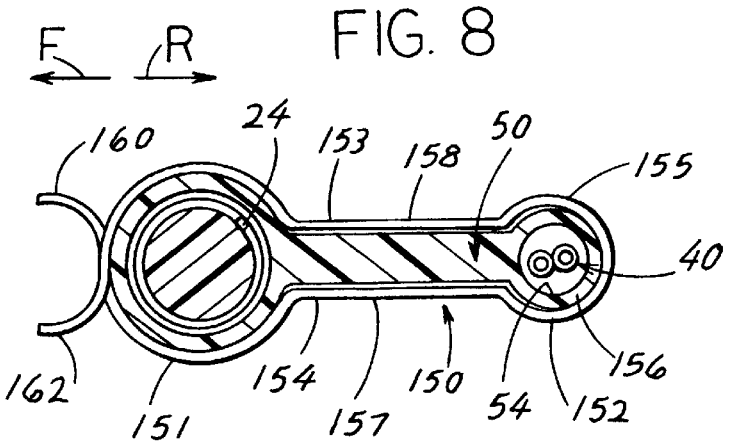
FIG. 8 is a sectional view of the antenna of FIG. 1, showing the tuning member.

50. The tuning member is formed of conductive material, preferably sheet metal such as steel. As shown in FIG. 8, the tuning member has front and rear ends 151, 152 that lie adjacent to the lower conductor 24 and the feedline 40, respectively. Each end preferably extends at least about 180° around the lower conductor and about the feed line. Parts 153, 154 connect the opposite ends.

The tuning member is in the form of a clip sleeve that includes a base 155 at its rear end that extends around the walls 156 of the bore 54 and the feedline 40 therein, and a pair of arms 157, 158 that extend forwardly F from the base and that have forward ends that extend about the lower radiator 24. The forward end of one arm 157 is bent into a first handle 160 while the forward end of the second arm 158 is bent into a pair of second handles 162. A person can squeeze the handles together with a force such as 10 pounds to allow the tuning member to be slid to any position along the spacer. Release of the handles results in resistance to sliding of the tuning member.

Figure 9:
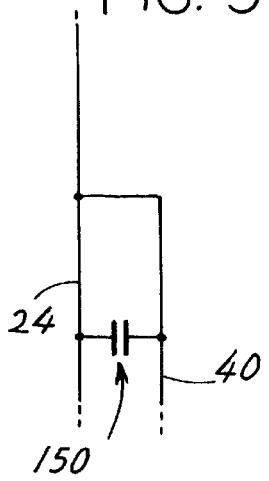
FIG. 9 is schematic diagram showing the effect of the tuning member.

As shown in FIG. 9, the electrically conductive tuning member 150 acts as a capacitor that couples the feedline 40 to the lower radiator 24, to lower the antenna resonant frequency and thereby tune the dipole to a selected frequency. Tests show that the tuning member has a negligible (unmeasurable) effect on the Q of the antenna, and that it permits tuning within a wide frequency range.

Figure 10:
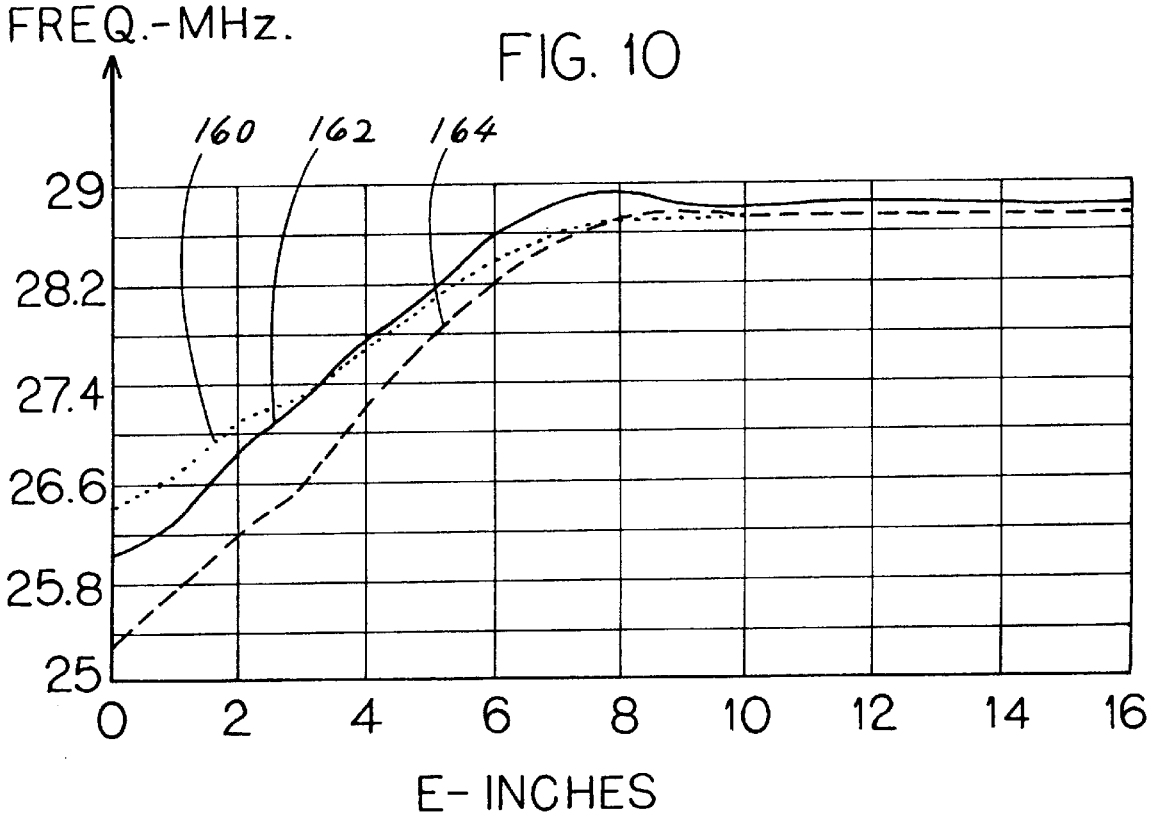
FIG. 10 contain graphs showing variation in antenna resonant frequency with height of the tuning member, for tuning members of different widths.

FIG. 10 contains graphs showing the change in dipole resonant frequency with distance E (FIG. 2) of the tuning member above the bottom of the spacer 50. Graphs 160, 162 and 164 are for tuning members of the construction of FIG. 4 but with different widths W of 0.25 inch, 0.5 inch, and 0.75 inch, respectively. The tests were conducted on a four foot no ground antenna. The frequency increases about linearly with height up to a height of about 6 inches. The distance between wire turns of the lower radiator is much greater above 6 inches than below it, which is a normal practice in loading short whip antennas, so the capacitive coupling is less above 6 inches.

An important advantage of the tuning member 150 compared to the traditional tuning pin 144 of FIG. 1, is that the tuning member 150 can be tuned without increasing the overall height B of the antenna above the vehicle body. The maximum height of the antenna is often limited by the height of parking garages etc. In addition, the antenna can be tuned without requiring a person to stand on a stepladder to reach the tuning pin. Both the tuning pin 144 and the tuning member 150 can be used, although the tuning pin can eliminated.

Thus, the invention provides an antenna that can operate without a highly conductive ground plane at the bottom of the antenna, and which is especially useful for mounting on non-conductive bodies of vehicles, which provides performance which is about as good as obtained from monopole antennas that are mounted on highly conductive ground planes of vehicles. The antenna is a vertical dipole with upper and lower radiators formed by vertically elongated conductors, with inner ends near the middle of the height of the antenna that are connected to a feedline. The portion of the feedline that lies close to the lower radiator, extends parallel to the lower radiator and is spaced at a fixed spacing therefrom. The complete feedline preferably includes a wire pair intermediate feedline extending along the height of the lower radiator, with an upper end connected to the inner ends of the upper and lower radiators and with a lower end connected to a coaxial cable coupling. The horizontal distance between the lower radiator and the intermediate feedline is preferably a plurality of centimeters (at least 2 centimeters) for a frequency of about 30 MHz (between 15 MHz and 45 MHz), and is preferably at least 0.2 percent of the wavelength for other frequencies (0.2% of a 396 inch wavelength is 0.8 inch). The lower portion of the dual wire pair feedline is wrapped about a ferrite core and extends to the coaxial cable connector, to block currents induced by emissions of the lower radiator that could otherwise pass back and forth between the transceiver and the dipole and result in wasted power. The spacing is preferably maintained by an elongated plastic extrusion having a pair of bores for closely receiving the lower radiator and the wire pair and having a rib connecting the walls of the two bores.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. An antenna comprising:

a primarily vertically extending dipole with upper and lower elongated conductors forming upper and lower radiators, with said conductors having adjacent inner ends and respective upper and lower ends;

an intermediate feedline in the form of a wire pair, for carrying radio frequency currents to said dipole, said intermediate feedline having an upper end connected to said inner ends of said conductors and said intermediate feedline extending generally downwardly from its upper end and including an RF cable connector connected to a lower end of said intermediate feedline;

said intermediate feedline has a radiator-opposite portion that extends parallel to and is spaced from said lower radiator;

a ferrite core lying along said intermediate feedline at a height no greater than the lower end of said lower conductor, with said intermediate feedline being wrapped a plurality of times about said ferrite core, to block the passage to said RF connector of signals picked up by said radiator-opposite portion of said intermediate feedline from energy radiated from said lower radiator.

2. An antenna for radiating electromagnetic energy, for mounting on the body of a vehicle, comprising:

a frame that includes a lower housing part with an enclosure constructed to mount on a mount location of the vehicle body and a dielectric spacer extending upwardly from said lower housing part;

a vertical dipole mounted on said frame above said body, said dipole including a middle and including upper and lower conductors that each has an inner end at said middle and an outer end furthest from said middle, with the outer ends of said upper and lower conductors lying respectively uppermost and lowermost;

a complete feedline for carrying RF currents, including an intermediate feedline portion with a radiator-opposite feedline part that extends parallel to said lower conductor and that lies at the same height as said lower conductor, with said spacer locating said feedline portion and at least the lower conductor of said dipole to keep them horizontally spaced apart and largely parallel;

a coaxial cable RF connector mounted on said lower housing part;

a ferrite core lying within said enclosure at a level at least as high as the vehicle body at said mount location, with said intermediate feedline being wrapped about said ferrite core, and with an end of said intermediate feedline connected to said coaxial cable RF connector.

3. The antenna described in claim 2 wherein:

said antenna is constructed to transmit at a frequency of about 30 MHz;

said intermediate feedline comprises a twisted wire pair with a portion of said twisted wire pair being wrapped about said ferrite core.

4. The antenna described in claim 2 wherein:

said spacer has a vertical length and is a plastic extrusion of constant cross-section along its vertical length with said bores spaced by at least two centimeters.

5. An antenna comprising:

a dipole with a middle and with first and second radiators extending in opposite directions from said middle, with each radiator having an axis and being elongated along its axis and with each radiator including an elongated conductor with an inner end lying at said dipole middle and with an outer end furthest from said dipole middle;

a feedline for carrying radio frequency currents to said dipole, said feedline connected to said inner ends of said conductors, and said feedline including a radiator-opposite feedline portion extending largely parallel and opposite said second radiator and being spaced from the axis of first radiator;

said dielectric spacer includes vertically elongated tubular walls forming vertically-elongated first and second parallel through bores and a rib that connects said tubular walls, with said second radiator extending through said first bore and with said radiator-opposite feedline portion extending through said second bore.

6. The antenna described in claim 5 including:

an electrically conductive tuning member which has opposite tuning member ends lying adjacent respectively to said second radiator and to said feedline opposite portion, said tuning member being mounted on said spacer at a selected one of a plurality of different positions on said spacer that are differently spaced from said outer end of said second radiator to tune said antenna to different frequencies;

said tuning member being free of direct electrical connection to said radiators and to said feedline.

7. An antenna comprising:

a dipole with a middle and with first and second radiators extending in opposite directions from said middle, with each radiator having an axis and being elongated along its axis and with each radiator including an elongated conductor with an inner end lying at said dipole middle and with an outer end furthest from said dipole middle;

a feedline for carrying radio frequency currents to said dipole, said feedline connected to said inner ends of said conductors, and said feedline including a radiator-opposite feedline portion extending largely parallel and opposite said second radiator and being spaced from the axis of the first radiator;

an electrically conductive tuning member having first and second ends lying respectively adjacent to said second radiator and to said feedline but free of direct connection to either of them, said tuning member being vertically moveable to a plurality of positions that are of different distances from said outer end of said second radiator to tune said antenna to different frequencies.

8. The antenna described in claim 7 wherein:

each of said ends of said tuning member extends at least about 180° around said second radiator and around said feedline.

* * * * *